US008382443B2

(12) United States Patent
Nakano et al.

(10) Patent No.: US 8,382,443 B2
(45) Date of Patent: Feb. 26, 2013

(54) CONTROL DEVICE FOR ELECTRIC COMPRESSOR AND START CONTROL METHOD OF ELECTRIC COMPRESSOR

(75) Inventors: Koji Nakano, Aichi-ken (JP); Takashi Nakagami, Aichi-ken (JP); Hiroyuki Kamitani, Aichi-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1029 days.

(21) Appl. No.: 12/304,099

(22) PCT Filed: Sep. 25, 2008

(86) PCT No.: PCT/JP2008/067242

§ 371 (c)(1),
(2), (4) Date: Dec. 9, 2008

(87) PCT Pub. No.: WO2009/081636

PCT Pub. Date: Jul. 2, 2009

(65) Prior Publication Data

US 2010/0232982 A1 Sep. 16, 2010

(30) Foreign Application Priority Data

Dec. 20, 2007 (JP) ..... 2007-329265

(51) Int. Cl.

| | |
|---|---|
| ***F04B 49/00*** | (2006.01) |
| ***F25B 1/00*** | (2006.01) |
| ***F25B 49/00*** | (2006.01) |
| ***F25D 17/04*** | (2006.01) |

(52) U.S. Cl. ..... 417/42; 62/228.1; 62/186

(58) Field of Classification Search ..... 417/42; 62/228.1, 186

See application file for complete search history.

(56) References Cited

U.S. PATENT DOCUMENTS

2005/0183434 A1 8/2005 Iritani et al.

FOREIGN PATENT DOCUMENTS

| | | | |
|---|---|---|---|
| DE | 10 2005 008 089 | A1 | 9/2005 |
| JP | 60-129896 | U | 8/1985 |
| JP | 06-233589 | A | 8/1994 |
| JP | 2005-241112 | A | 9/2005 |
| JP | 2007-151318 | A | 6/2008 |

OTHER PUBLICATIONS

Machine translation of JP 2003-139069 to Makoto provided.*

International Search Report of PCT/JP2008/067242, date of mailing date Dec. 9, 2008.

* cited by examiner

*Primary Examiner* — Anh Mai
*Assistant Examiner* — Zachary J Snyder
(74) *Attorney, Agent, or Firm* — Westerman, Hattori, Daniels & Adrian, LLP

(57) ABSTRACT

Control device for an electric compressor and a start control method of an electric compressor that can smoothly and reliably start the electric compressor even at high temperature. Even in a high temperature state of a power transistor, a rotational speed or an acceleration rate of a motor according to the temperature is set to gradually start the electric compressor. After the commencement of the start, the temperature of the power transistor is repeatedly checked for every predetermined time to update the rotational speed or the acceleration rate of the motor, and the rotational speed or the acceleration rate of the motor is increased according to the temperature of the power transistor, thereby allowing quick start.

8 Claims, 7 Drawing Sheets

CONTROL DEVICE FOR ELECTRIC COMPRESSOR AND START CONTROL METHOD OF ELECTRIC COMPRESSOR

TECHNICAL FIELD

The present invention relates to a control device for an electric compressor that constitutes an air conditioner and a start control method thereof.

BACKGROUND ART

In recent years, a so-called electric compressor has been developed using an electric motor as a drive source of a compressor for compressing a refrigerant in an automotive air conditioner.

Such an electric compressor is still under development, and there are various problems to be solved. Particularly, there are many problems at the start, and various proposals have been made for quick and reliable start (for example, see Patent Document 1).

[Patent Document 1] Japanese Patent Laid-Open No. 2007-151318

One of the problems at the start of the electric compressor is that the electric compressor cannot be smoothly started at high temperature due to a temperature characteristic of a power transistor provided on a drive control board of the electric compressor.

The power transistor has a temperature characteristic that a current that can be carried becomes lower at higher temperatures, and includes a protection circuit that stops an operation of the electric compressor at high temperature. Thus, when the electric compressor is to be started when in a high temperature state, the protection circuit of the power transistor is operated to stop the operation of the electric compressor and prevent the start.

Thus, as shown in FIG. 7, when the protection circuit of the power transistor is operated, it is necessary that the electric compressor is rotated at a low speed for a certain time and a rotational speed of the electric compressor is manually increased after the certain time passes and the power transistor is sufficiently cooled, which takes time to start the electric compressor.

The present invention is achieved on the basis of such technical problems, and has an object to provide a control device for an electric compressor and a start control method of an electric compressor that can smoothly and reliably start the electric compressor even at high temperature.

DISCLOSURE OF THE INVENTION

To achieve the above described object, the present invention provides a control device for an electric compressor for driving a compressor that constitutes an air conditioner with a motor, characterized in that processings performed by the control device when the motor is started and increased in rotational speed up to a target rotational speed include: a processing of detecting a temperature of a power transistor provided in the control device; a processing of determining a rotational speed of the motor or an acceleration rate in increasing the rotational speed of the motor corresponding to the detected temperature of the power transistor, on the basis of a predetermined correlation; and a processing of driving the motor at the determined rotational speed or acceleration rate.

Thus, the correlation between the temperature of the power transistor and the rotational speed or the acceleration rate of the motor is previously determined, and the rotational speed of the motor or the acceleration rate in increasing the rotational speed of the motor is determined according to the temperature of the power transistor to drive the motor. This allows the motor to be gradually driven at a low speed or a low acceleration when the temperature of the power transistor is high, thereby allowing the electric compressor to be started even in the case where the electric compressor cannot be started in the conventional example.

It is preferable that the processing of detecting the temperature of the power transistor is repeated at intervals, and the rotational speed or the acceleration rate of the motor is updated according to a newly detected temperature of the power transistor.

The temperature detection is repeated to allow the rotational speed or the acceleration rate of the motor to be set according to the temperature of the power transistor at different times. Specifically, in the case where the motor is started to cause a refrigerant to flow in the electric compressor and the refrigerant cools the power transistor, when the power transistor is started to be cooled by the refrigerant, the rotational speed of the motor or the acceleration rate in increasing the rotational speed of the motor can be increased. This allows quicker start of the electric compressor.

The present invention provides a start control method of an electric compressor for driving a compressor that constitutes an air conditioner with a motor, comprising the steps of: detecting a temperature of a power transistor provided in the control device when the motor is started and increased in rotational speed up to a target rotational speed; determining a rotational speed of the motor or an acceleration rate in increasing the rotational speed of the motor corresponding to the detected temperature of the power transistor, on the basis of a predetermined correlation; and driving the motor at the determined rotational speed or acceleration rate.

According to the present invention, the rotational speed or the acceleration rate of the motor is determined according to the temperature of the power transistor to drive the motor, thereby allowing the motor to be gradually driven at a low speed or a low acceleration when the temperature of the power transistor is high. Thus, even in a high temperature state of the power transistor where the electric compressor cannot be started in the conventional example, the rotational speed or the acceleration rate can be set according to the temperature to gradually start the electric compressor.

After the commencement of the start, the temperature of the power transistor is repeatedly checked to successively update the rotational speed or the acceleration rate of the motor. Thus, the rotational speed or the acceleration rate of the motor can be increased according to the temperature of the power transistor, thereby allowing quick start of the electric compressor. Further, when the refrigerant starts to flow in the electric compressor with the start, the temperature of the power transistor decreases, and thus a synergistic effect can be obtained.

DESCRIPTION OF SYMBOLS

10 . . . electric compressor, 11 . . . compressor body, 12 . . . motor, 13 . . . control board, 15 . . . control device, 20 . . . power transistor, 30 . . . start controller, 40 . . . temperature sensor

BEST MODE FOR CARRYING OUT THE INVENTION

Now, the present invention will be described in detail on the basis of an embodiment shown in the accompanying drawings.

Figure 1:
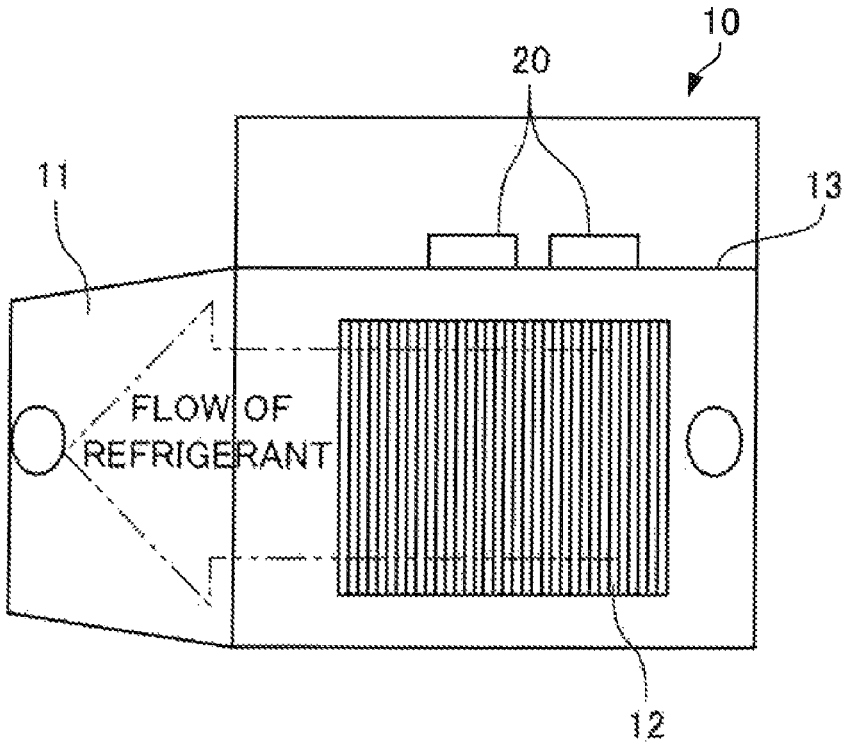
FIG. 1 shows a schematic configuration of an electric compressor according to a present embodiment.

As shown in FIG. 1, an electric compressor 10 that constitutes an automotive air conditioner includes a compressor body 11 that compresses a refrigerant, a motor 12 for driving the compressor body 11, and a control board 13 for rotating the motor 12.

Figure 2:
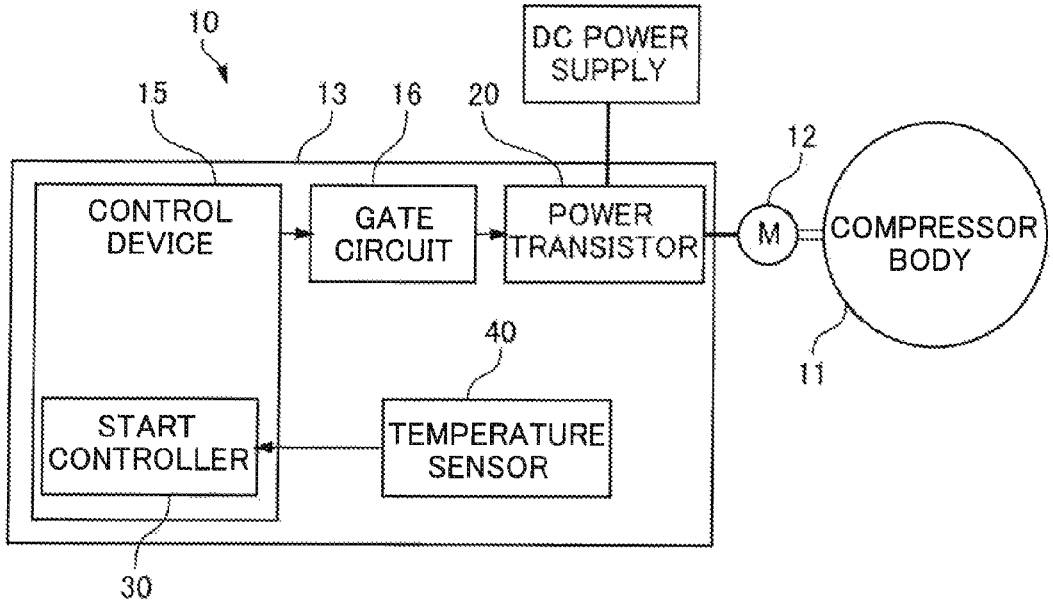
FIG. 2 is a block diagram of a functional configuration of the electric compressor.

As shown in FIG. 2, the control board 13 includes a power transistor 20 for converting a voltage supplied from a DC power supply into an AC voltage, and a control device 15 constituted by a microcomputer for controlling an operation of the power transistor 20 and a gate circuit 16. The gate circuit 16 is driven by control of the control device 15, and when a drive signal thereof is inputted to the power transistor 20, the power transistor 20 operates. Thus, the voltage supplied from the DC power supply is converted into a three-phase AC voltage and applied to the motor 12 of the electric compressor 10 to rotationally drive the motor 12.

As shown in FIG. 2, the control device 15 functionally includes a start controller 30 that performs control at the start of the electric compressor 10. For the control by the start controller 30, a temperature sensor 40 that detects a temperature of the power transistor 20 is provided on the control board 13.

The start controller 30 functionally performs start control as described below in the electric compressor 10 by the control device 15 performing a predetermined processing based on a previously stored program.

Figure 3:
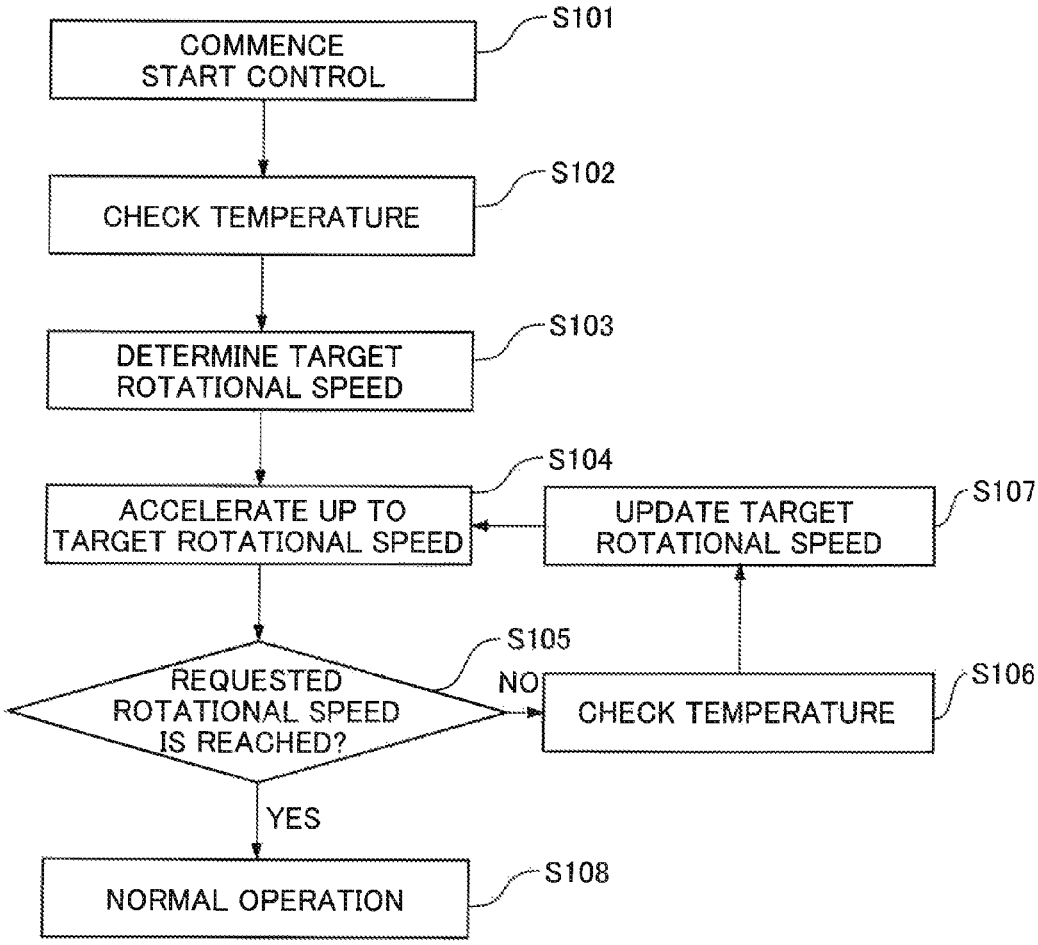
FIG. 3 shows an example of a flow of processing for controlling a rotational speed of a motor according to a temperature of a power transistor.

Specifically, as shown in FIG. 3, when a start command of the electric compressor 10 is inputted from a host control device on a vehicle side, the start controller 30 commences the start control of the electric compressor 10 (Step S101). At this time, the start command from the host control device contains a command of a requested rotational speed R1 of the electric compressor 10.

Figure 4A:
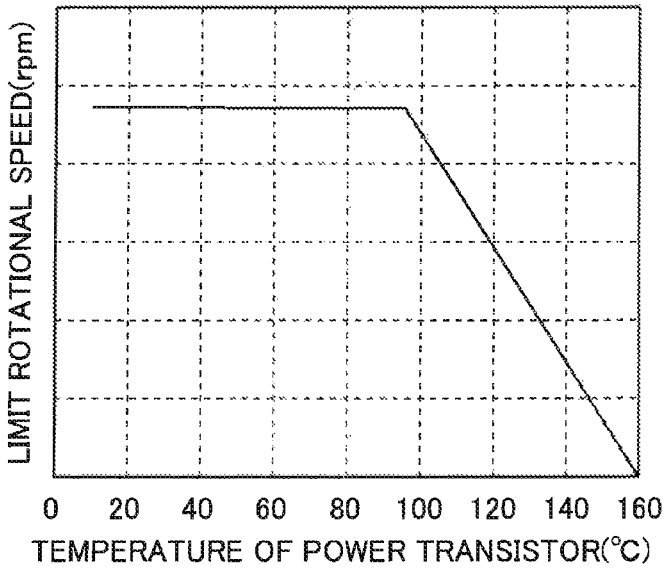
FIG. 4A shows a relationship between the temperature of the power transistor and a limit rotational speed of the motor.

Then, the start controller 30 checks the temperature of the power transistor 20 detected by the temperature sensor 40 (Step S102). The start controller 30 refers to predetermined correlation data between a temperature of the power transistor 20 and a limit rotational speed of the electric compressor 10 as illustrated in FIG. 4A. Then, a limit rotational speed R2 of the electric compressor 10 corresponding to the detected temperature of the power transistor 20 checked in Step S102 is obtained, and the obtained limit rotational speed R2 is determined as a target rotational speed R3 (Step S103). An upper limit of the target rotational speed R3 is the requested rotational speed R1 contained in the start command inputted in Step S101. Specifically, when the limit rotational speed R2 exceeds the requested rotational speed R1, the target rotational speed R3 is set as the requested rotational speed R1.

After the target rotational speed R3 is determined, the start controller 30 drives the gate circuit 16 to operate the power transistor 20, the three-phase AC voltage is applied to the motor 12 to rotationally drive the motor 12, and the rotational speed of the motor 12 is accelerated so that the rotational speed of the motor 12 reaches the target rotational speed R3 (Step S104).

After a predetermined time passes, it is determined whether the rotational speed of the motor 12 reaches the requested rotational speed R1 (Step S105). When the requested rotational speed R1 is not reached, the temperature of the power transistor 20 detected by the temperature sensor 40 is checked (Step S106).

Then, as in Step 5103, the correlation data between the temperature of the power transistor 20 and the limit rotational speed of the electric compressor 10 as illustrated in FIG. 4A is referred to, the limit rotational speed R2 of the electric compressor 10 corresponding to the detected temperature of the power transistor 20 is obtained, and the obtained limit rotational speed R2 is updated as a new target rotational speed R3 (Step S107). Also at this time, the upper limit of the target rotational speed R3 is the requested rotational speed R1 contained in the start command inputted in Step S101.

Then, the process returns to Steps 5104 and S105, the rotation of the motor 12 is accelerated so that the rotational speed of the motor 12 reaches the new target rotational speed R3, and when a predetermined time passes, it is determined whether the rotational speed of the motor 12 reaches the target rotational speed R3. Then, the check of the temperature of the power transistor 20 and the update of the target rotational speed R3 in Steps S106 and 107 are repeated to accelerate the rotation of the motor 12 until the rotational speed of the motor 12 reaches the requested rotational speed R1.

When the rotational speed of the motor 12 reaches the requested rotational speed R1, the start operation by the start controller 30 is finished, and the process moves to a normal operation (Step S108).

Figure 4B:
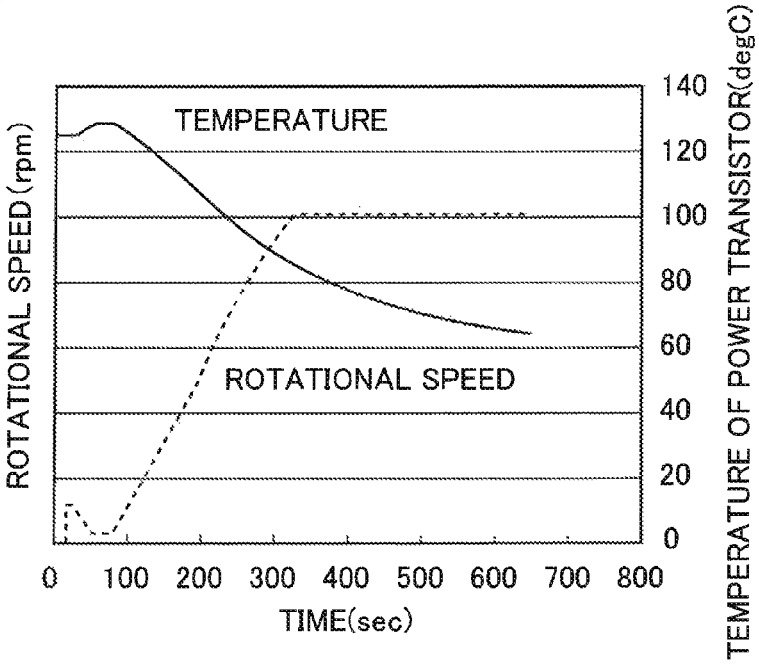
FIG. 4B shows changes in rotational speed of the motor and temperature of the power transistor when the motor is started by the method in FIG. 3.

Thus, as shown in FIG. 4B, even in a high temperature state of the power transistor 20, the target rotational speed R3 according to the temperature can be set to gradually start the electric compressor 10. After the commencement of the start, the temperature of the power transistor 20 is repeatedly checked for every predetermined time to update the target rotational speed R3. Thus, the target rotational speed R3 can be increased according to the temperature of the power transistor 20, thereby allowing quick start of the electric compressor 10 up to the requested rotational speed R1. As shown in FIG. 1, when the refrigerant starts to flow in a housing of the electric compressor 10 with the start, the control board 13 is cooled and the temperature of the power transistor 20 decreases, and thus a synergistic effect can be obtained.

In the above description, the method of controlling the rotational speed of the motor 12 according to the temperature of the power transistor 20 is described, but a method of controlling a rotation acceleration rate of the motor 12 according to the temperature of the power transistor 20 may be used. This will be now described.

Figure 5:
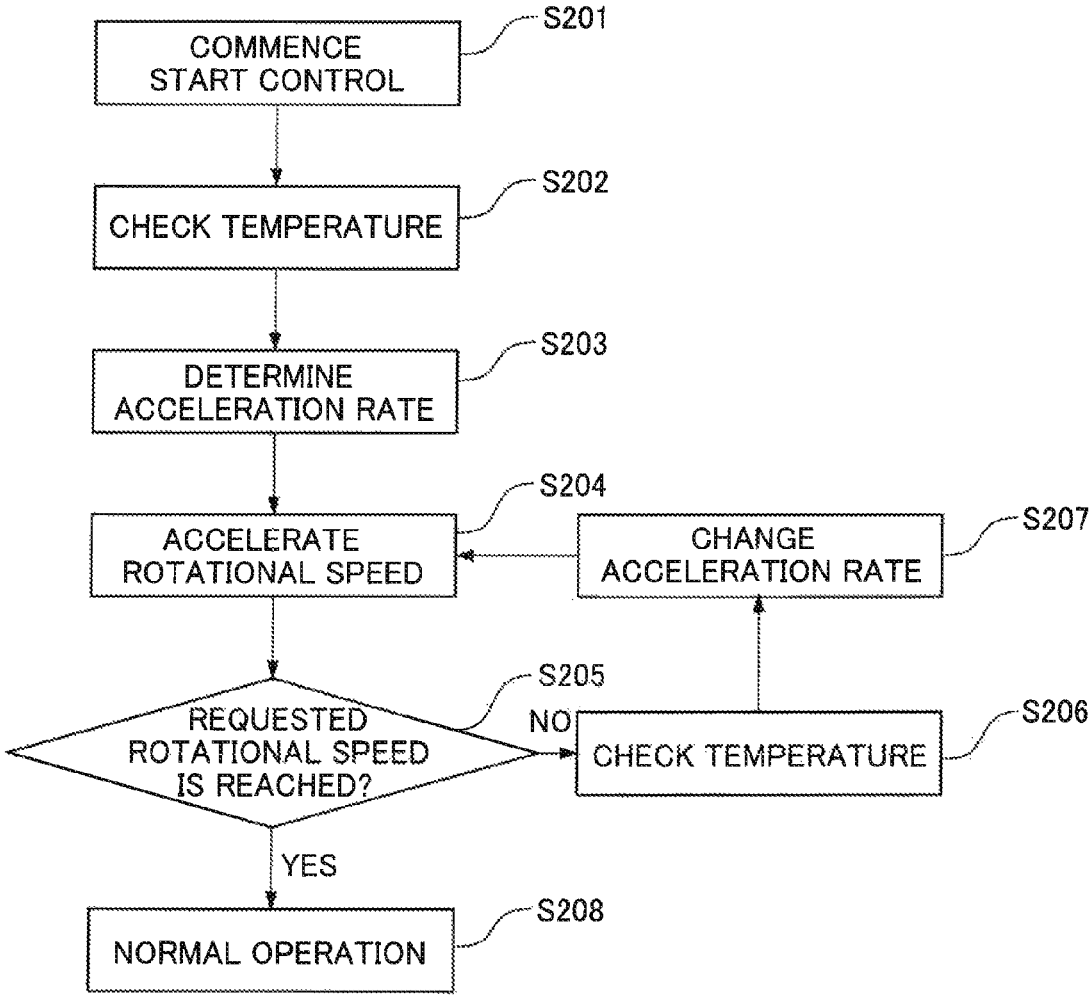
FIG. 5 shows an example of a flow of processing for controlling an acceleration rate of the motor according to the temperature of the power transistor.

As shown in FIG. 5, when a start command of the electric compressor 10 is inputted from a host control device on a vehicle side, the start controller 30 commences the start control of the electric compressor 10 (Step S201). At this time, the start command from the host control device contains a command of a requested rotational speed R1 of the electric compressor 10.

Figure 6A:
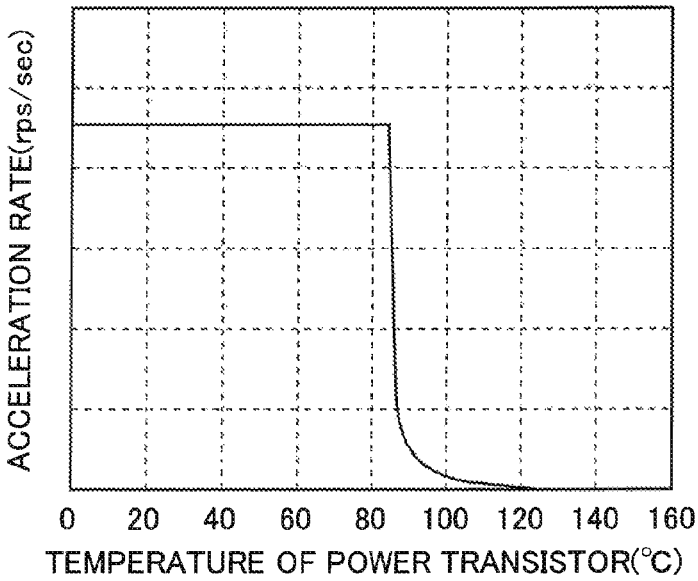
FIG. 6A shows a relationship between the temperature of the power transistor and the acceleration rate of the motor.

Then, the start controller 30 checks the temperature of the power transistor 20 detected by the temperature sensor 40 (Step S202). The start controller 30 refers to predetermined correlation data between a temperature of the power transistor 20 and the rotation acceleration rate of the motor 12 as illustrated in FIG. 6A. Then, an acceleration rate of the electric compressor 10 corresponding to the detected temperature of the power transistor 20 checked in Step S202 is obtained (Step S203).

Then, the start controller 30 increases the rotational speed of the motor 12 at the acceleration rate obtained in Step S203 (Step S204).

After a predetermined time passes, it is determined whether the rotational speed of the motor 12 reaches the requested rotational speed R1 (Step S205). When the requested rotational speed R1 is not reached, the temperature of the power transistor 20 detected by the temperature sensor 40 is checked (Step S206). Then, as in Step S203, the correlation data between the temperature of the power transistor 20 and the rotation acceleration rate of the motor 12 as illustrated in FIG. 6A is referred to, the rotation acceleration rate of the electric compressor 10 corresponding to the detected temperature of the power transistor 20 is obtained, and the obtained rotation acceleration rate is updated as a new rotation acceleration rate (Step S207).

Then, the process returns to Steps S204 and S205, the rotational speed of the motor 12 is increased at the updated rotation acceleration rate, and after a predetermined time passes, it is determined whether the rotational speed of the motor 12 reaches the requested rotational speed R1. Then, the check of the temperature of the power transistor 20 in Steps S206 and S207 and the update of the rotation acceleration rate are repeated to accelerate the motor 12 until the rotational speed of the motor 12 reaches the requested rotational speed R1.

When the rotational speed of the motor 12 reaches the requested rotational speed R1, the start operation by the start controller 30 is finished, and the process moves to a normal operation (Step S208).

Figure 6B:
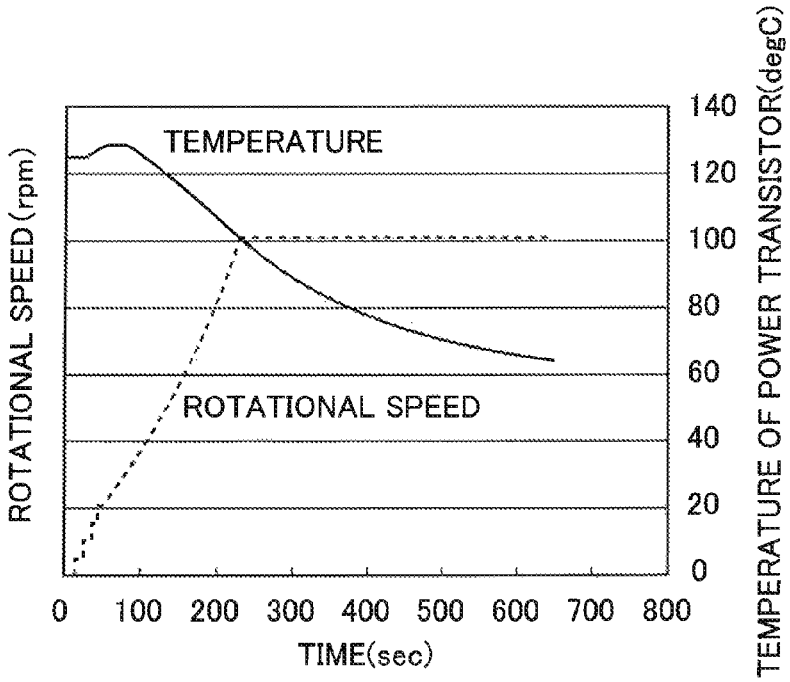
FIG. 6B shows changes in rotational speed of the motor and temperature of the power transistor when the motor is started by the method in FIG. 5.
Figure 7:
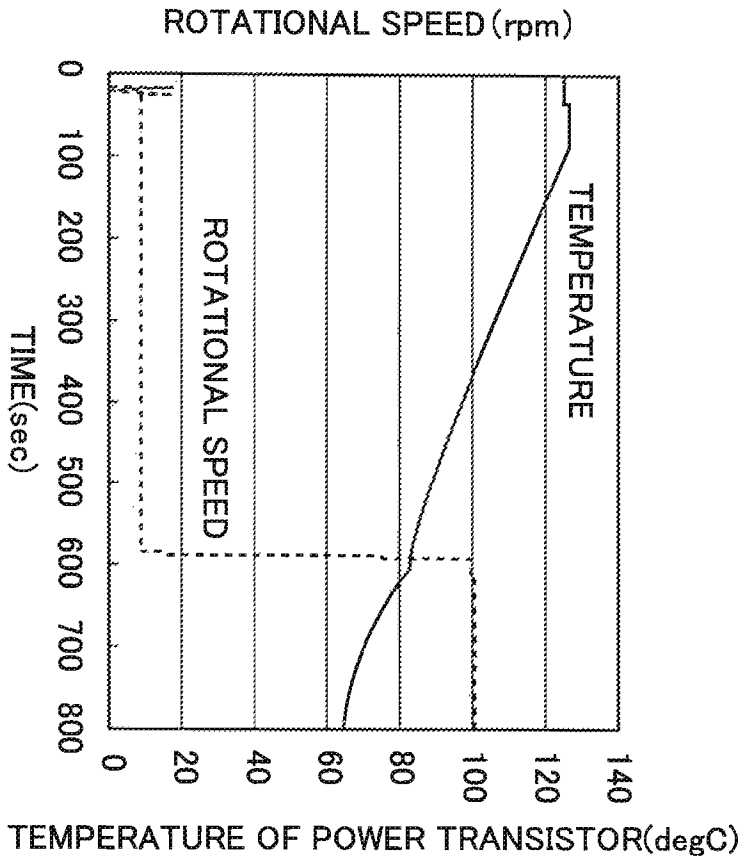
FIG. 7 shows changes in rotational speed of a motor and temperature of a power transistor when the motor is started by a conventional method.

Thus, as shown in FIG. 6B, even in a high temperature state of the power transistor 20, the acceleration rate according to the temperature can be set to gradually start the electric compressor 10. After the commencement of the start, the temperature of the power transistor 20 is repeatedly checked for every predetermined time to update the acceleration rate. Thus, the acceleration rate can be increased according to the temperature of the power transistor 20, thereby allowing quick start of the electric compressor 10. When the refrigerant starts to flow in the housing of the electric compressor 10 with the start, the control board 13 is cooled and the temperature of the power transistor 20 decreases, and thus a synergistic effect can be obtained.

In the above described embodiment, the electric compressor 10 may have any configuration without departing from the gist of the present invention. The motor 12 and the compressor body 11 are not limited to be integrated, and the present invention is particularly effectively applied to an electric compressor having a structure in which when the refrigerant starts to flow in the housing of the electric compressor 10 with the start, the control board 13 is cooled by the refrigerant.

Further, the configuration described in the embodiment may be chosen or changed to other configurations without departing from the gist of the present invention.

The invention claimed is:

1. A control device for an electric compressor for driving a compressor that constitutes an air conditioner with a motor, wherein processings performed by said control device when said motor is started and increased in rotational speed up to a target rotational speed comprise:

a processing of detecting a temperature of a power transistor provided in said control device;

a processing of determining a rotational speed of said motor or an acceleration rate in increasing the rotational speed of said motor corresponding to the detected temperature of said power transistor, on the basis of a predetermined correlation; and a processing of driving said motor at said determined rotational speed or acceleration rate.

2. The control device for an electric compressor according to claim 1, wherein the processing of detecting the temperature of said power transistor is repeated at intervals, and said rotational speed or said acceleration rate of said motor is updated according to a newly detected temperature of said power transistor.

3. The control device for an electric compressor according to claim 1, wherein said power transistor is cooled by a refrigerant flowing in said electric compressor by the start of said motor.

4. A start control method of an electric compressor for driving a compressor that constitutes an air conditioner with a motor, characterized by comprising the steps of:

detecting a temperature of a power transistor provided in said control device;

determining a rotational speed of said motor or an acceleration rate in increasing the rotational speed of said motor corresponding to the detected temperature of said power transistor, on the basis of a predetermined correlation; and driving said motor at said determined rotational speed or acceleration rate, when said motor is started and increased in rotational speed up to a target rotational speed.

5. The start control method of an electric compressor according to claim 4, wherein the processing of detecting the temperature of said power transistor is repeated at intervals, and said rotational speed or said acceleration rate of said motor is updated according to a newly detected temperature of said power transistor.

6. The start control method of an electric compressor according to claim 4, wherein said power transistor is cooled by a refrigerant flowing in said electric compressor by the start of said motor.

7. The control device for an electric compressor according to claim 1, wherein the motor is gradually driven at a low speed or a low acceleration when the temperature of the power transistor is high.

8. The start control method of an electric compressor according to claim 4, wherein the motor is gradually driven at a low speed or a low acceleration when the temperature of the power transistor is high.

* * * * *